US005826488A

United States Patent [19]

Arai et al.

[11] Patent Number: 5,826,488

[45] Date of Patent: Oct. 27, 1998

[54] SWASH PLATE ANGLE CHANGING APPARATUS FOR A PISTON PUMP/MOTOR OF SWASH PLATE TYPE

[75] Inventors: Mitsuru Arai; Hideki Kado; Sadao Nunotani; Koichi Morita; Mitsuru Oshiro; Seita Hayashi, all of Tochigi, Japan

[73] Assignee: Komatsu Ltd., Tokyo, Japan

[21] Appl. No.: 817,812

[22] PCT Filed: Oct. 18, 1995

[86] PCT No.: PCT/JP95/02136

§ 371 Date: Apr. 14, 1997

§ 102(e) Date: Apr. 14, 1997

[87] PCT Pub. No.: WO96/12107

PCT Pub. Date: Apr. 25, 1996

[30] Foreign Application Priority Data

Oct. 18, 1994 [JP] Japan ..... 6-252256

[51] Int. Cl.[6] ..... F01B 3/00; F04B 1/22

[52] U.S. Cl. ..... 92/12.2; 92/57; 92/71; 91/506; 417/269; 74/60

[58] Field of Search ..... 92/12.2, 57, 71; 91/506; 417/269; 74/60

[56] References Cited

U.S. PATENT DOCUMENTS

| | | | |
|---|---|---|---|
| 2,915,985 | 12/1959 | Budzich | 92/57 |
| 4,581,980 | 4/1986 | Berthold | 91/506 |
| 5,649,468 | 7/1997 | Tsurumi et al. | 91/506 |

FOREIGN PATENT DOCUMENTS

| | | | |
|---|---|---|---|
| 1314483 | 12/1962 | France | 92/12.2 |
| 3-164573 | 7/1991 | Japan . | |
| 4-109079 | 4/1992 | Japan . | |
| 4-42550 | 7/1992 | Japan . | |
| 6-26447 | 2/1994 | Japan . | |

*Primary Examiner*—Thomas E. Denion

*Attorney, Agent, or Firm*—Frishauf, Holtz, Goodman, Langer & Chick

[57] ABSTRACT

In a piston pump/motor of swash plate type which comprises: a cylinder block disposed in a casing to be rotatable jointly with a shaft therein; a plurality of pistons slidably inserted in the cylinder block parallel to the shaft; and a swash plate swingably attached to the casing for guiding the plurality of pistons on a front surface thereof and changing a displacement of each of the pistons by changing an inclination thereof, there is provided a swash plate angle changing apparatus in which the swash plate has a rear surface formed with a first contact surface and a second contact surface which make an angle between them. The casing has a swash plate support surface which is perpendicular to the shaft and with which the first contact surface and the second contact surface are each adapted to contact. The casing has a swash plate angle changing piston; the swash plate is swung by a force resultant from thrust forces of the pistons in the direction of the swash plate to a first position whereby the first contact surface makes contact with the swash plate support surface to yield a large angle of the said swash plate and also is swung by a thrust force of the swash plate angle changing piston to a position whereby the second contact surface makes contact with the swash plate support surface to yield a small angle of the swash plate; and the said swash plate has a center of swing located closer to the front surface than the rear surface of the swash plate.

3 Claims, 8 Drawing Sheets

SWASH PLATE ANGLE CHANGING APPARATUS FOR A PISTON PUMP/MOTOR OF SWASH PLATE TYPE

TECHNICAL FIELD

The present invention relates to an apparatus for changing the angle of a swash plate for a piston pump/motor of swash plate type which is used as a motor for driving a construction machine or the like.

BACKGROUND ART

As the piston pump/motor of swash plate type, there has hitherto been known what is disclosed, for example, in Japanese Examined Patent Publication No. Hei 4-42550.

Specifically in such a piston pump/motor of swash plate type, as shown in FIG. 1 of the drawings attached hereto, a shaft 2 is rotatably supported in a casing 1 and has coupled thereto a cylinder block 3 that is so arranged as to be rotatable jointly with the said shaft 2 therein. The cylinder block 3 is formed in parallel to the said shaft 2 with a plurality of cylinder bores 4 which are spaced apart from one another in a circumferential direction thereof. Each of the cylinder bores 4 has a piston 5 slidably inserted fittedly therein, thereby forming a cylinder chamber 6 within the said cylinder bore 4. Also, the said shaft 2 has coupled thereto a thrust ball 16 in which is fitted a shoe 7 that is made oblique to the said shaft 2 by being arranged along a swash plate 8. The said thrust ball 16 and the said shoe 7 are so designed that they may be rotated jointly with the said shaft 2 and is also energized by a spring 17 towards the side of the said swash plate 8. In addition, each of the pistons 5 has its forward end that is coupled with the said shoe 7 universally. And, the assembly constituted of the foregoing components is so constructed that if a pressure fluid is supplied from and drained into, a fluid source (not shown) into and from, the pressure receiving chamber 6 of each of the said cylinder bores 4 to reciprocate the said pistons 5, the said swash plate 8 will act to rotate the said shaft 2 as well as the said cylindrical block 3 by guiding the shoes 7 and the said pistons 5 in the said circumferential direction. Conversely, if the said shaft 2 and the said cylinder block 3 are rotated, the said pistons 5 will each be reciprocated, thus serving as a pump. It is these components that constitutes the basic section of a piston pump/motor of swash plate type.

The above mentioned piston pump/motor of swash plate type has a capacity that is changed by a reciprocating displacement of the said piston 5 which is made when the said cylinder block 3 assumes one rotation, and the magnitude of the reciprocating displacement of the said piston 5 is determined by an angle that is made by a front surface 8*a* of the said swash plate 8 with respect to a center line 2*a* of the said shaft 2, that is, by a so called swash plate angle.

An apparatus for changing the above mentioned swash plate angle has hitherto had a construction, for example, as shown in FIG. 1, in which a rear surface 8*b* of the above mentioned swash plate 8 is formed with a first contact surface 9 and a second contact surface 10 which make a predetermined angle between them, a ball 12 is fitted between a boundary portion of the said first and second contact surfaces 9 and 10 and a swash plate support surface 11 of the said casing 1 to swingably support the said swash plate 8, the said swash plate 8 is swung clockwise by a force resultant from the thrust forces of such pistons 5 in the direction of the said swash plate 8 to push the said first contact surface 9 against the said swash plate support surface 11 with a resulting large angle of the said swash plate 8. The said swash plate 8 is also swung by a thrust force of a swash angle changing piston 13 that is attached to the said casing 1, against the force resultant from the thrust forces of the said pistons 5 in the direction of the swash plate to push the said second contact surface 10 against the said swash plate support surface 11 with a resulting small angle of the said swash plate.

More specifically, as shown in FIG. 2 of the drawings attached hereto, the resultant force Fa of the said piston thrust forces towards the said swash plate 8 will be applied to a point perpendicularly to the said front surface 8*a* and the swash plate 8 to offset the said point of application by a length $L_1$ closer to the said first contact surface 9 from a center (i.e. a swash plate swing center) 12*a* of the said ball 12 so that said resultant force Fa may cause a moment in the direction of arrow a to act on the said swash plate 8. On the other hand, the thrust force Fb of the said swash plate angle changing piston 13 may cause a moment in the direction of arrow b to act on the said swash plate 8, thus making the latter moment in the direction of arrow b greater than the previously mentioned moment in the direction of arrow a by locating the latter's point of application closer to the said first contact surface 9 further diametrically than the point of application of the said resultant force Fa.

With the above mentioned structure, the said swash plate support surface 11 is made perpendicular to the said center line 2*a* of the shaft 2 whilst the said center 12*a* of the ball 12 is located on the said swash plate support surface 11. Since this causes the said center 12*a* of the ball 12 and the said surface 8*a* of the swash plate 8 to be spaced apart by a distance $L_2$ that is identical to the thickness of the swash plate 8 which needs to be sufficient to a degree for the reason of its strength, it will follow that the above mentioned distance $L_2$ between the said center 12*a* of the ball 12 and the said front surface 8*a* of the swash plate 8 needs to be sufficiently long.

On the other hand, the above mentioned point of application of the said resulting force Fa of the piston thrust forces towards the said swash plate 8 must be offset diametrically closer to the said first contact surface 9 from the said center 12*a* of the ball 12, and yet the said point of application of the said resultant force Fa of the said piston thrust forces towards the said swash plate 8 will be somewhat deviated by the angle of rotation of the said cylinder block 3 and the amount of such deviation will then be made greater as the number of the said pistons 5 is made lesser.

For this reason, since the offset between the point of application of the said resultant force of the said piston thrust forces towards the said swash plate 8 and the said center 12*a* of the ball 12 has the said length $L_1$ that needs to be set so as to be greater than the above mentioned amount of deviation of the point of action of the said resultant force of the said piston thrust forces towards the said swash plate 8 by the rotation of the said cylinder block 3, there will be a lengthened distance $L_3$, from the said center line 2*a* of the shaft 2 to the said center 12*a* of the ball 12.

This will cause the moment for swinging the said swash plate 8 in the direction of arrow a with the said resultant force Fa of the said piston thrust forces towards the said swash plate 8 to be enlarged and a need will then develop for the moment for swinging the said swash plate 8 in the direction of arrow b to be enlarged by increasing the said thrust force Fb of the swash plate angle changing piston 13. There will also be a shortened distance $L_4$ from the said center 12*a* of the ball 12 to one end portion 8*c* of the said swash plate 8, by a lengthened distance $L_3$ from the said center line 2*a* of the shaft 2 to the said center 12*a* of the ball 12.

However, if the said moment due to the said thrust force Fb of the swash plate angle changing piston 13 will become greater and yet if the above mentioned distance $L_4$ is shortened, the said swash plate 8 will be floated up with the contact area between the said second contact surface 10 and the said swash plate support surface 11 as a fulcrum and will then become unstable. Then, the measure that has hitherto been taken in the prior art is to lengthen a distance $L_5$ from the said center line 2*a* of the shaft 2 to the said one end portion 8*c* of the swash plate 8, thereby lengthening the above mentioned distance $L_4$ so as not to allow the said swash plate 8 to be floated up.

However, since the said swash plate 8 becomes larger as mentioned above, then the said casing 1 and hence the entire piston pump/motor of swash plate type will proportionally be enlarged. To meet this problem, the measure that has been taken in the prior art is to set the number of the said pistons 5 to be nine so as to reduce the amount of deviation of the point of application of the said resultant force of the piston thrust forces towards the said swash plate 8, thereby not allowing the said swash plate 8 to be enlarged to prevent it from being floated up and thus reducing the size of the piston pump/motor of swash plate type.

At this point, it should be noted that although it has hitherto been proposed, as disclosed in Japanese Patent Application No. Hei 1-301822 (Japanese Unexamined Patent Publication No. Hei 3-164573), not to allow the swash plate to be enlarged by making an inclination of a said swash plate support surface of the casing with respect to the right angle direction to the center line of a said shaft to prevent the swash plate from being floated up, it has been found that such a measure makes the machining of the said swash plate support surface extremely troublesome.

More specifically, if the said swash plate support surface 11 is made perpendicular to the said center line 2*a* of the shaft 2 as shown in FIG. 1, the axis of machining of the said swash plate support surface 11 and the axial support bore 14 of the said casing 1 will be coaxial to each other. Then, although the machining can be easily carried out in a short period of time for its procedures since it can be done with the said axial support bore 14 as a reference, it has been found that if the said swash plate support surface 11 is not made as perpendicular to the said center line 2*a* of the shaft, the said axial support bore 14 and the said axis of machining will not be made coaxial to each other, the machining procedures will be lengthened in time and made troublesome.

Accordingly, it is an object of the present invention to provide a swash plate angle changing apparatus for a piston pump/motor of swash plate type, which is capable of preventing a swash plate from being floated up if a swash plate support surface is oriented to be perpendicular to the center line of a shaft, and without enlarging the swash plate.

SUMMARY OF THE INVENTION

In order to achieve the object mentioned above, there is provided in accordance with the present invention, in a first general form of embodiment thereof, in a piston pump/motor of swash plate type which comprises: a cylinder block that is disposed in a casing so as to be rotatable jointly with a shaft therein; a plurality of pistons each of which is slidably inserted in the said cylinder block in parallel to the said shaft; and a swash plate that is swingably attached to the said casing for guiding the said plurality of pistons on a front surface thereof in a circumferential direction of the said cylinder block whilst changing a displacement of each of the said pistons by changing an inclination thereof, a swash plate angle changing apparatus for the piston pump/motor of swash plate type, in which the said swash plate has a rear surface that is formed with a first contact surface and a second contact surface which make an angle between them; the said casing is formed with a swash plate support surface which is perpendicular to the said shaft and with which the said first contact surface and the said second contact surface are each adapted to contact; the said casing is provided with a swash plate angle changing piston; the said swash plate is adapted to be swung by a force resultant from thrust forces of the said pistons in the direction of the said swash plate to a first position whereby the said first contact surface makes a contact with the said swash plate support surface to yield a large angle of the said swash plate and also to be swung by a thrust force of the said swash plate angle changing piston to a position whereby the said second contact surface makes a contact with the said swash plate support surface to yield a small angle of the said swash plate; and the said swash has a center of swing that is located closer to the said front surface than the said rear surface of the said swash plate.

According to the construction mentioned above, by virtue of the fact that the center of swing of the said swash plate is located closer to the said front surface than the said second contact surface of the said swash plate, it can be seen that if the distance between the said center of swing of the said swash plate and the point of application of the said resultant force of the said piston thrust forces towards the said swash plate is identical to that in the prior art, the distance between the said center line of the shaft and the said center of swing of the said swash plate will be shortened and the distance between the said center of swing of the said swash plate and one end portion of the said swash plate will then be proportionally lengthened.

It can also be seen that if the said swash plate support surface is perpendicular to the said center line of the shaft, the above will enable to prevent the said swash plate from being floated up by the said resultant forces of the said piston thrust forces towards the said swash plate without enlarging the said swash plate.

In connection with the above mentioned construction, it is preferred that the said swash plate be attached to the said casing by a support means which comprises: a swing fulcrum body that is fastened to said casing and a swing catch seat which is provided on the said rear surface of the swash plate and in which the said swing fulcrum is swingably fitted.

It should also be noted that the said swash plate is attached to the said casing by a support means which may comprise: a swing fulcrum body that is fastened to a recess of the said rear surface of the swash plate and a swing catch seat which is fastened to the said casing and in which the said swing fulcrum body is swingably fitted.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Figure 1:
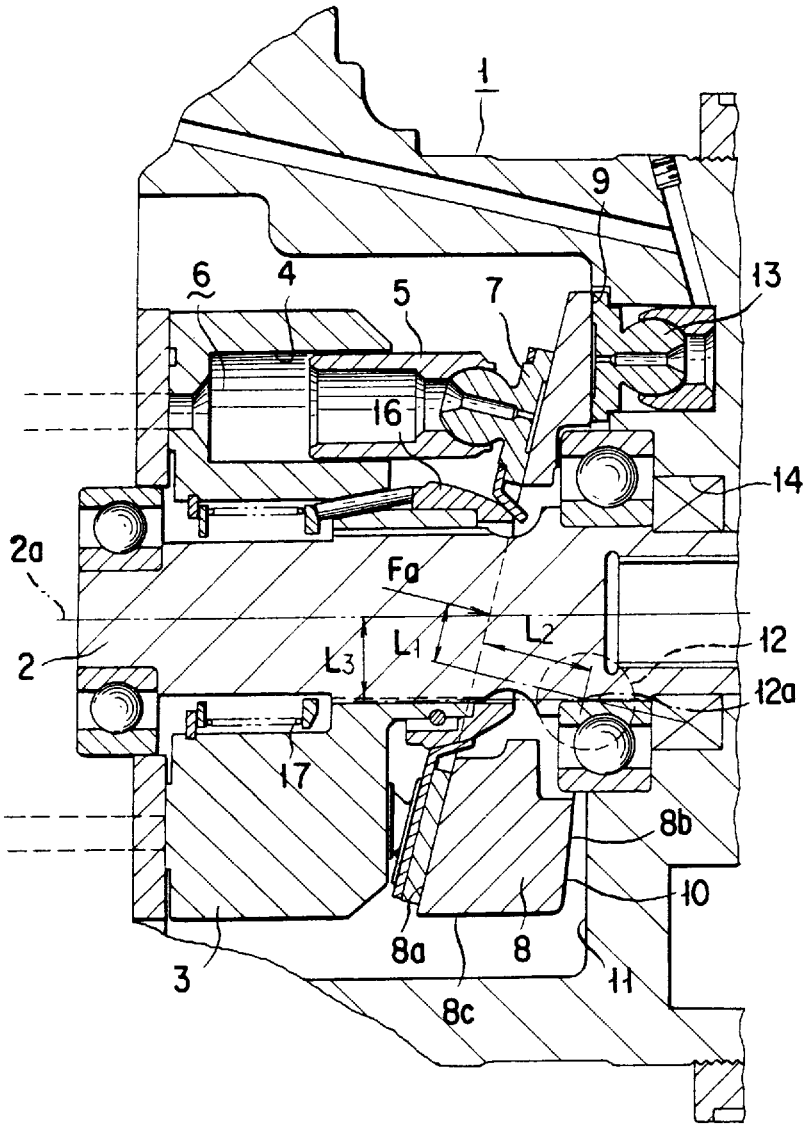
FIG. 1 (PRIOR ART)
FIG. 1 is a cross sectional view of piston pump/motor of a swash plate type incorporating a swash plate angle changing apparatus in the prior art.
Figure 2:
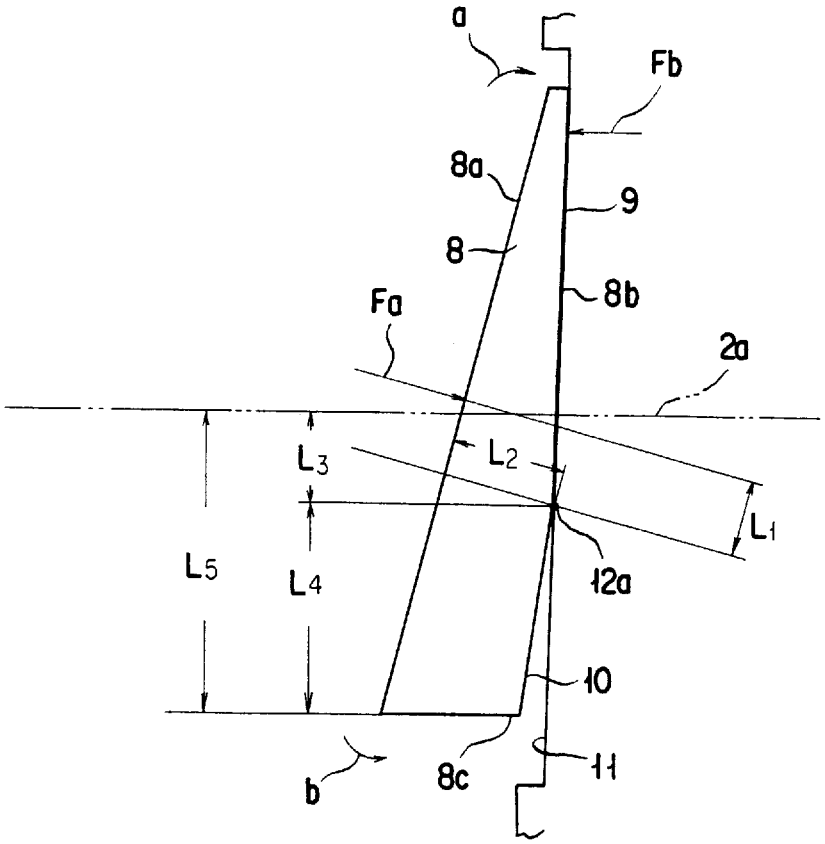
FIG. 2 (PRIOR ART)
FIG. 2 is an explanatory view of the swinging operation for a swash plate in the above mentioned prior art.
Figure 3:
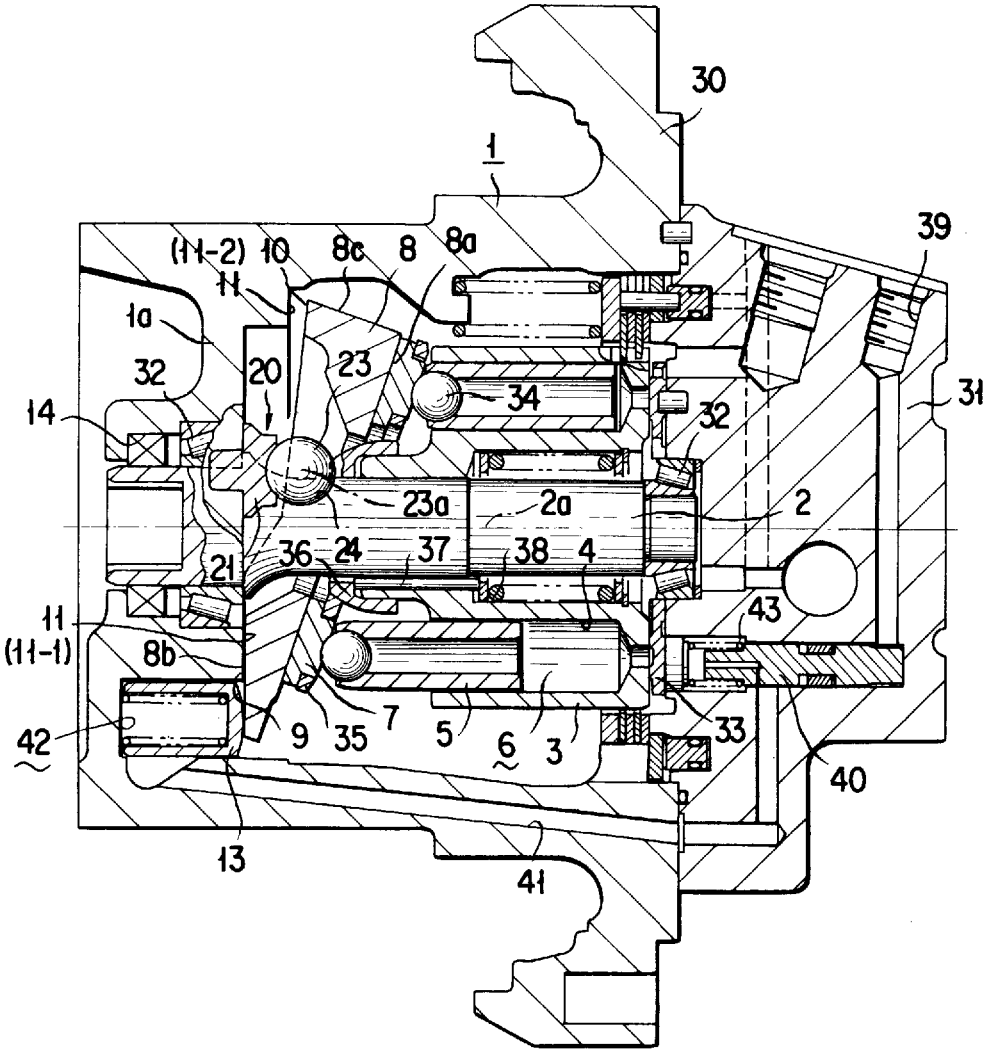
FIG. 3 is a cross sectional view of a piston pump/motor incorporating a certain embodiment of the swash plate angle changing apparatus according to the present invention.

Hereinafter, a suitable embodiment of the present invention with respect to a swash plate angle changing apparatus for a piston pump/motor of swash plate type will be set forth with reference to the accompanying drawings hereof.

A detailed explanation will now be given of a certain embodiment of the present invention with references to FIGS. 3 to 14. In making the explanation below, the same components or members as in the prior art will be designated by the same reference numerals.

A said shaft 2 is rotatably supported in a said casing 1 and has coupled thereto a said cylinder block 3 that is so arranged as to be rotatable jointly with the said shaft 2 therein. The said cylinder block 3 is formed in parallel to the said shaft 2 with a said plurality of cylinder bores 4 which are spaced apart from one another in a circumferential direction thereof. Each of the said cylinder bores 4 has a said piston 5 slidably inserted fittedly therein, thereby forming a said cylinder chamber 6 within the said cylinder bore 4. Also, the said shaft 2 has coupled thereto a thrust ball 36 in which is fitted a said shoe 7 that is made oblique to the said shaft 2 by being arranged along a said swash plate 8. The said thrust ball 36 and the said shoe 7 are so designed that they may be rotated jointly with the said shaft 2 and are also energized by a spring 38 towards the side of the said swash plate 8. In addition, each of the pistons 5 has its forward end that is coupled with the said shoe 7 universally. And, the assembly constituted of the foregoing components is so constructed that if a pressure fluid is supplied from and drained into, a fluid source (not shown) into and from, the pressure receiving chamber 6 of each of the said cylinder bores 4 to reciprocate the said pistons 5, the said swash plate 8 will act to rotate the said shaft 2 as well as the said cylindrical block 3 by guiding the shoes 7 and the said pistons 5 in the said circumferential direction. Conversely, if the said shaft 2 and the said cylinder block 3 are rotated, the said pistons 5 will each be reciprocated, thus serving as a pump. It is these components that constitutes the basic section of a piston pump/motor of swash plate type.

The above mentioned swash plate 8 has a said rear surface 8*b* that is formed with a said first contact surface 9 and a said second contact surface 10 which make a predetermined angle between them. The said swash plate 8 is supported by a pair of swash plate support members 20 so as to be capable of being swung in the said casing 1. The said swash plate 8 is swung in the direction of arrow a by a said force resultant from the thrust forces Fa of the said pistons 5 towards the said swash plate 8 to a position at which the said first contact surface 9 makes a contact with a said swash plate support surface 11 and is also swung in the direction of arrow b by a said thrust force of a said swash plate angle changing piston 13 to a position at which the said second contact surface makes a contact with a said swash plate support surface 11.

The above mentioned swash plate support surface 11 is perpendicular to the said center line 2*a* of the shaft 2 and comprised of a first swash plate support surface 11-1 on one side thereof and a second swash plate support surface 11-2 on the other side thereof about a said center line 2*a* of the said shaft 2. The said first swash plate support surface 11-1 and the said second swash plate support surface 11-2 are deviated from each other in position in the axial direction of the said shaft 2.

In this manner, since the said swash plate support surface 11 is made perpendicular to the said center line 2*a* of the shaft 2, the axis of machining of the said swash plate support surface 11 and the axial support bore 14 of the said casing 1 will be coaxial to each other. Then, the machining can be easily carried out in a short period of time for its procedures since it can be done with the said axial support bore 14 as a reference.

In connection with the above, it should be noted that the said first and second swash plate support surfaces 11-1 and 11-2 may be identical in position in the axial direction of the said shaft 2.

Figure 4:
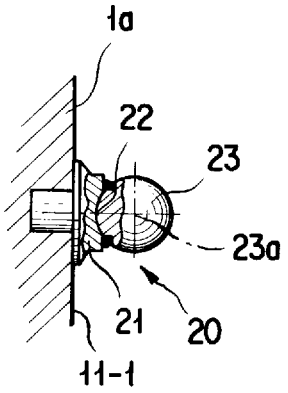
FIG. 4 is a front view of a first example of the swash plate support member according to the above mentioned embodiment.

Each of the above mentioned swash plate support members 20 comprises, as shown in FIG. 4, an attachment body 21 that is securely fixed to an end wall portion 1*a* of the said casing 1 and a swing fulcrum body 23 in the form of a spherical body that is securely fixed by welding or the like to a spherical recessed portion 22 of the said attachment body 21. And, the said swing fulcrum body 23 has its center 23*a* that is deviated in position in the axial direction of the said shaft 2, closer to the side of the said swash plate 8 than to an inner surface (i.e. the said first swash plate support surface 11-1) of the said end wall portion 1*a*, and is swingably fitted in a swing catch seat 24 that is constituted by a spherical recessed portion which is open to the said rear surface 8*b* of the swash plate 8. The center of the said swing catch seat 24 is deviated in position closer to the said front surface 8*a* of the swash plate 8 than the said rear surface 8*b* thereof (i.e. the said first contact surface 9 and the said second contact surface 10). Thus, the center of swing of the swash plate 8 (i.e. the said center 23*a* of the swing fulcrum body 23) as well is deviated in position (i.e. offset) closer to the said front surface 8a than the said rear surface 8*b* of the swash plate 8.

Figure 5:
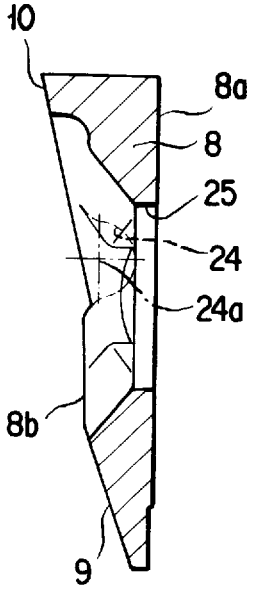
FIG. 5 is a cross sectional view of the swash plate in the above mentioned embodiment.
Figure 6:
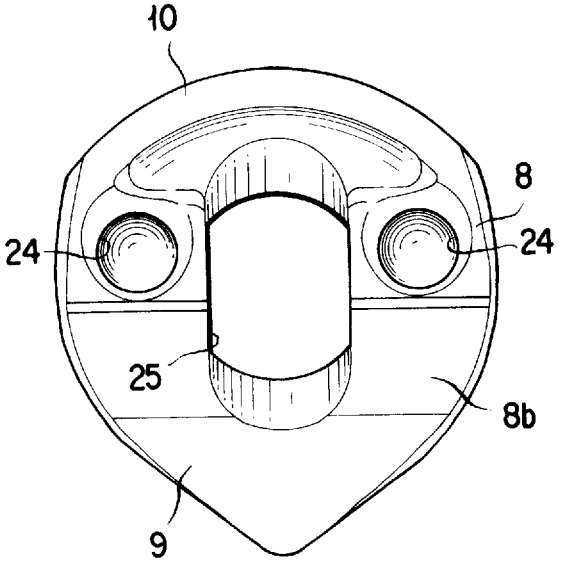
FIG. 6 is a side elevational view of the swash plate in the above mentioned embodiment.

More specifically, as shown in FIGS. 5 and 6, the said swash plate 8 has a bore 25 through which the said shaft 2 penetrates, and such swing catch seats 24 which are constituted by a pair of spherical recessed portions are formed diametrically closer to the said second contact surface 10 at both sides of the said bore 25 in the said rear surface 8*b*. And, each of the said swing catch seats 24 has its center 24*a* that is deviated in position closer to the said front surface 8*a* than to the said rear surface 8*b* (i.e. the said first contact surface 9 and the said second contact surface 10).

An explanation will next be given with respect to a detailed structure of each of the foregoing components.

The said casing 1 comprises a motor case 30 and a cover 31, and the said shaft 2 is supported by the said motor case 30 and the said cover 31 via a bearing 32 so as to be rotatable therein. And, the said cylinder block 3 is fitted in, and coupled in a spline arrangement with, the said shaft 2 so as to be capable of rotation jointly with the said shaft 2 whereas a valve plate 33 is interposed between the said cylinder block 3 and the said cover 31 so that the said cylinder block 3 may be rotated along the said valve plate 33.

The said shoe 7 is provided with a ball 34 that is rotatably coupled to the said piston 5 and is pushed against the said front surface 8*a* of the swash plate 8 with a shoe retainer 35, a retainer guide 36, a pin 37 and a spring 38.

Next, an explanation will be given of the foregoing embodiment when it is operating as a motor.

If a pressure fluid is supplied into a pilot port 39, a swash plate angle switching valve spool 40 will be switched by being displaced leftwards against a spring 43 so that the motor's own pressure (i.e. the pressure that is the higher one of the motor inlet pressure and the motor outlet pressure) may be applied into a fluid chamber 42 through a fluid passage 41 and that the said swash plate angle changing piston 13 may be projection operated under the pressure within the said fluid chamber 42 to swing the said swash plate 8 in the counter-clockwise direction and then to cause the said second contact surface 10 of the swash plate 8 to make a contact with the said second swash plate support surface 11-2 with a resulting small angle of the said swash plate 8.

This will allow the piston pump/motor of swash plate type to have a reduced capacity and the said shaft 2 to be rotated jointly with the said cylinder block 3 at an increased velocity.

On the other hand, when the pressure fluid is no longer supplied into the said pilot port 39, the said swash plate angle switching valve spool 40 will be switched by a spring 43 which then acts to displace it rightwards. Then, since the said swash plate angle changing piston 13 will have a reduced thrust force, the said fluid passage 41 will be allowed to communicate with the interior of the said casing 1. As a result, the swash plate 8 will be swung in the clockwise direction by the said resultant forces of the piston thrust forces in the direction of the swash plate 8 so that the said first contact surface 9 of the swash plate 8 may make a contact with the said first swash plate support surface 11-1 with a resulting large angle of the said swash plate 8.

This will allow the piston pump/motor of swash plate type to have an increased capacity and the said shaft 2 to be rotated jointly with the said cylinder block at a reduced velocity.

Thus, with the components that are so constructed and operated as described above, it can be seen, as shown in FIG. 7, that the distance $L_2$ between the said center 23*a* of the swing fulcrum body 23 and the said front surface 8*a* of the swash plate 8 will become shorter than the thickness of the said swash plate 8. At the same time, the distance $L_3$ between the said center 23*a* of the swing fulcrum body 23 and the said center line 2*a* of the shaft 2 will become shorter and the distance between the said center 23*a* of the swing fulcrum body 23 and the said one end portion 8*c* of the swash plate 8 will then become proportionally longer. As a consequence, it will be possible to shorten the distance $L_5$ between the said center line 2*a* of the shaft 2 and the said one end portion 8*c* of the swash plate 8. At this point it should be noted in FIG. 7 that the numeral 5*a* represents a center of coupling between the said piston 5 and the said shoe 7.

Accordingly, it can be seen that without enlarging the said swash plate 8, it will be possible to prevent the swash plate 8 from being floated up when the said swash plate 8 is swung in the direction of arrow b with the thrust force Fb of the said swash plate angle changing piston 13.

Figure 7:
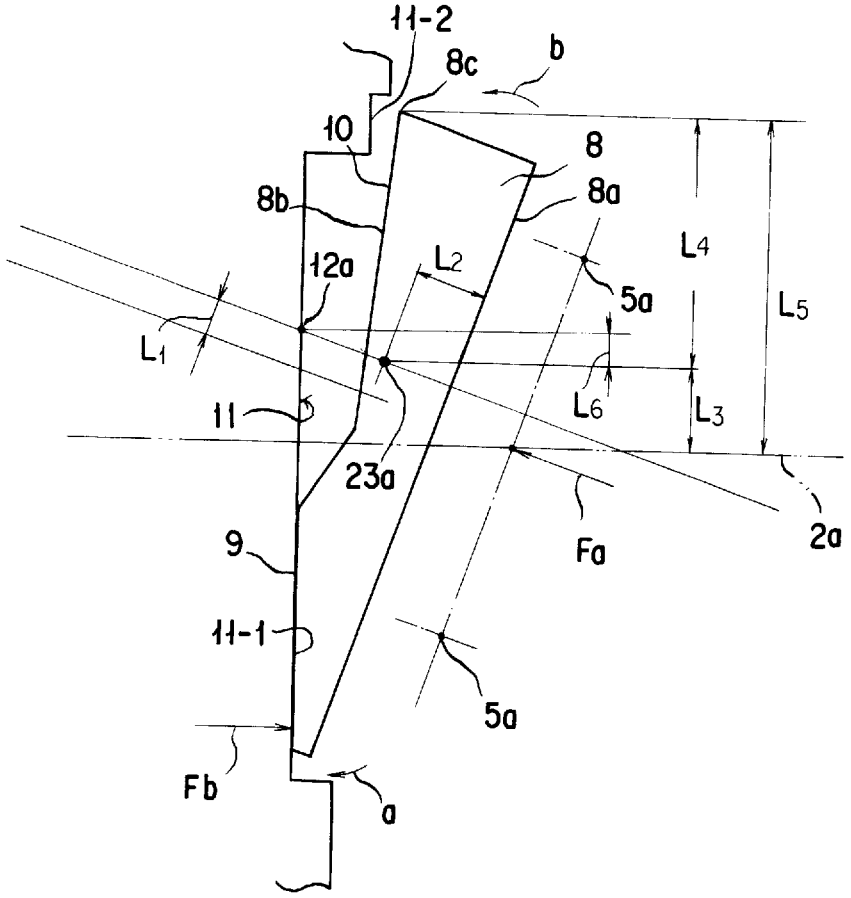
FIG. 7 is an explanatory view of the swash plate swing operation in the above mentioned embodiment.

In a comparison with a conventional apparatus, it can be seen that the said center 12*a* of the ball 12 falls on the said swash plate support surface 11 in the prior art (that corresponds to the said first swash plate support surface 11-1 in the present embodiment of the invention). Thus, as shown in FIG. 7, the distance between the ball center 12*a* if applied to the prior art and the center line 2*a* of the shaft 2 would be lengthened by an amount $L_6$ and it would then be necessary to enlarge the swash plate 8 by the said amount.

Figure 8:
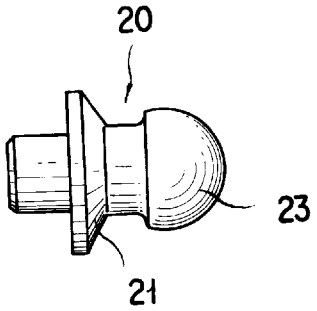
FIG. 8 is a front view showing a second example of the swash plate support member.
Figure 9:
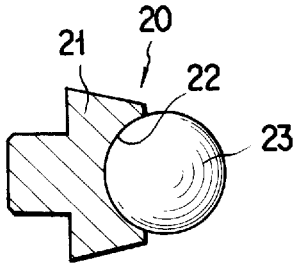
FIG. 9 is a front view showing a third example of the swash plate support member.
Figure 10:
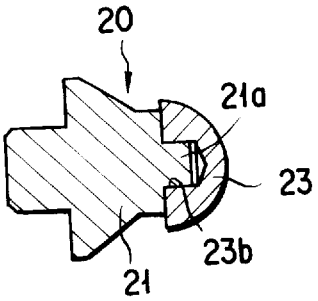
FIG. 10 is a front view showing a fourth example of the swash plate support member.
Figure 11:
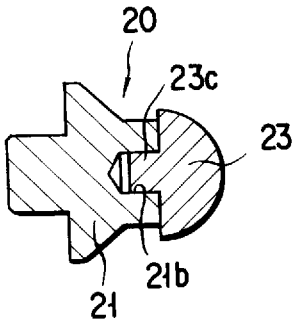
FIG. 11 is a front view showing a fifth example of the swash plate support member.

At this point it should be noted that the said attachment body 21 and the said swing fulcrum body 23 may be integrally shaped as shown in FIG. 8, and they can be separately shaped and then assembled for use as shown in FIG. 9. Alternatively, the said attachment body 21 may be formed with a projection 21*a* whilst the said swing fulcrum body 23 may be formed with a recess 23*b* so that the said projection 21*a* may be fitted into the said recess 23*b* as shown in FIG. 10. Still alternatively, the said attachment body 21 may be formed with a recess 21*b* whilst the said swing fulcrum body 23 may be formed with a projection 23*c* so that the said projection 23*c* may be fitted into the said recess 21*b* as shown in FIG. 11.

Figure 12:
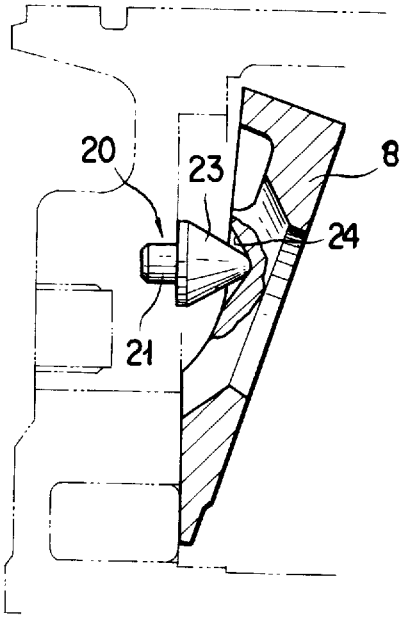
FIG. 12 is a front view showing a sixth example of the swash plate support member.

Further, as shown in FIG. 12, it should be noted that the above mentioned swing fulcrum body 23 may be integrally shaped with the said attachment body 21 and can be of a conical configuration with its forward end which may then be of a spherical configuration. In this case, the said swing catch seat 24 ought to be approximately of a recessed conical configuration with its bottom surface which can then be of a recessed spherical configuration.

Figure 13:
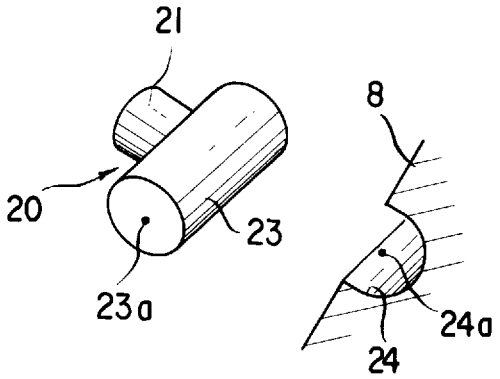
FIG. 13 is a front view showing a seventh example of the swash plate support member.

Also, the above mentioned swing fulcrum body 23 may be shaped as columnar as shown in FIG. 13. In this case, the said swing catch seat 24 ought to be an elongate hole that should be circular in cross section.

Figure 14:
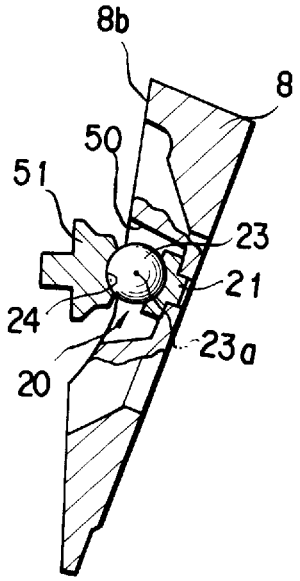
FIG. 14 is a cross sectional view showing another example of the swash plate support structure.

Another modification is shown in FIG. 14 in which a recess 50 may be formed in the said rear surface 8*b* of the swash plate 8 and may have a said swash plate support member 20 attached thereto. Then, a said attachment member 51 may be affixed to the said casing 1 and the said swing catch seat 24 therefor may be fitted in the said swing fulcrum body 23 of the swash plate support member 20 to allow the said swash plate 8 to be rotatable.

As set out in the foregoing description of a swash plate angle changing apparatus for a piston pump/motor of swash plate type according to the present invention, it should be noted that by virtue of the fact that the center of swing of the said swash plate is located closer to the front surface of the swash plate than to the second contact surface of the said swash plate, it can be seen that if the distance between the said center of swing of the swash plate and the point of application of the said resultant force of the piston thrust forces towards the said swash plate 8 is identical to that in the prior art, the distance between the said center line of the shaft and the said center of swing of the said swash plate will be shortened and the distance between the said center of swing of the said swash plate and one end portion of the said swash plate will then be proportionally lengthened.

It can also be seen that if the said swash plate support surface is perpendicular to the said center line of the shaft, the above construction will enable to prevent the said swash plate from being floated up by the said resultant forces of the said piston thrust forces towards the said swash plate without enlarging the said swash plate. Thus, a compact piston pump/motor of swash plate type can be provided in which a said swash support surface may be readily machined.

While the present invention has hereinbefore been described with respect to a certain illustrative embodiment thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. In a piston pump/motor of swash plate type which comprises: a cylinder block that is disposed in a casing so as to be rotatable jointly with a shaft therein; a plurality of pistons each of which is slidably inserted in said cylinder block parallel to said shaft; and a swash plate that is swingably attached to said casing for guiding said plurality of pistons on a front surface thereof in a circumferential direction of said cylinder block while changing a displacement of each of said pistons by changing an inclination thereof, a swash plate angle changing apparatus for the piston pump/motor of swash plate type, in which said swash plate has a rear surface that is formed with a first contact surface and a second contact surface which make an angle between them; said casing is formed with a swash plate support surface which is perpendicular to said shaft and with which said first contact surface and said second contact surface are each adapted to contact; said casing is provided with a swash plate angle changing piston; said swash plate is adapted to be swung by a force resultant from thrust forces of said pistons in the direction of said swash plate to a first position whereby said first contact surface makes a contact with said swash plate support surface to yield a large angle of said swash plate and also to be swung by a thrust force of said swash plate angle changing piston to a position whereby said second contact surface makes a contact with said swash plate support surface to yield a small angle of said swash plate; and said swash plate has a center of swing that is located closer to said front surface than said rear surface of said swash plate.

2. A swash plate angle changing apparatus for the piston pump/motor of swash plate type, as set forth in claim 1, in which said swash plate is attached to said casing by a support devices which comprises: a swing fulcrum body that is fastened to said casing and a swing catch seat which is provided on said rear surface of the swash plate and in which said swing fulcrum is swingably fitted.

3. A swash plate angle changing apparatus for the piston pump/motor of swash plate type, as set forth in claim 1, in which said swash plate is attached to said casing by a support device which comprises: a swing fulcrum body that is fastened to a recess of said rear surface of the swash plate and a swing catch seat which is fastened to said casing and in which said swing fulcrum body is swingably fitted.

* * * * *